US011154126B1

(12) United States Patent
Zheng et al.

(10) Patent No.: US 11,154,126 B1
(45) Date of Patent: Oct. 26, 2021

(54) REPLENISHABLE DISPENSER

(71) Applicant: APR Beauty Group, Inc., Ontario (CA)

(72) Inventors: Min-Yan Zheng, Ontario (CA); Feng-Ying Fu, Ontario (CA)

(73) Assignee: APR Beauty Group Inc, Toronto (CA)

( * ) Notice: Subject to any disclaimer, the term of this patent is extended or adjusted under 35 U.S.C. 154(b) by 0 days.

(21) Appl. No.: 17/068,171

(22) Filed: Oct. 12, 2020

(51) Int. Cl.

| | |
|---|---|
| ***A45D 34/04*** | (2006.01) |
| ***A45D 34/00*** | (2006.01) |
| ***A61J 7/00*** | (2006.01) |
| ***B05B 11/02*** | (2006.01) |
| ***B05B 11/00*** | (2006.01) |
| ***A46B 11/00*** | (2006.01) |
| ***B05C 17/005*** | (2006.01) |

(52) U.S. Cl.
CPC ..... *A45D 34/042* (2013.01); *A61J 7/0076* (2013.01); *B05B 11/0054* (2013.01); *B05B 11/0097* (2013.01); *B05B 11/02* (2013.01); *A45D 2034/005* (2013.01); *A45D 2200/053* (2013.01); *A45D 2200/054* (2013.01); *A45D 2200/056* (2013.01); *A45D 2200/1018* (2013.01); *A46B 11/002* (2013.01); *A46B 11/0024* (2013.01); *B05C 17/00569* (2013.01)

(58) Field of Classification Search
CPC .... A45D 34/042; A45D 40/262; A45D 34/00; A45D 2034/005; A45D 2034/00; A45D 2200/1018; A45D 2200/053; A45D 2200/054; A45D 2200/056; A61J 7/0076; B05B 11/02; B05B 11/0054; B05B 11/0097; B05C 17/00569; B05C 17/00; B05C 17/005; A46B 11/00; A46B 11/001; A46B 11/0065
USPC ..... 401/188 R, 216, 132–134, 270
See application file for complete search history.

(56) References Cited

U.S. PATENT DOCUMENTS

| | | | | | |
|---|---|---|---|---|---|
| 4,208,144 | A * | 6/1980 | Idec | A45D 40/06 | 132/320 |
| 4,359,292 | A * | 11/1982 | Thompson | B65D 47/42 | 401/213 |
| 5,851,080 | A * | 12/1998 | Nakajima | A46B 11/0079 | 401/279 |
| 6,406,207 | B1 * | 6/2002 | Wiegner | A46B 11/0027 | 401/272 |
| 6,533,482 | B1 * | 3/2003 | Byun | A45D 34/04 | 401/180 |
| 7,101,107 | B1 * | 9/2006 | Byun | A45D 34/042 | 401/286 |
| 7,497,635 | B1 * | 3/2009 | Bae | A45D 34/04 | 401/188 R |

* cited by examiner

*Primary Examiner* — David J Walczak
(74) *Attorney, Agent, or Firm* — Hill Wallack LLP; Jason L DeFrancesco

(57) ABSTRACT

A replenishable dispenser for dispensing a liquid product. The replenishable dispenser comprises a housing, a canister for storing the liquid product, a triggering unit, an application member and a suction assembly for dispensing the liquid product from the canister to the application member upon being actuated by the triggering unit. The canister is detachably connected to the housing to replace the canister upon being exhausted with a new canister to replenish the dispenser. The dispenser further includes an applicator tip detachably connected to a holding unit of the application member.

12 Claims, 5 Drawing Sheets

REPLENISHABLE DISPENSER

BACKGROUND

Field of the Invention

The present invention relates to a replenishable dispenser for dispensing liquid product(s). More particularly, the present invention relates to a dispenser with a canister, wherein the existing canister is replaceable with new canister as per the volume of liquid inside the canister.

Description of the Related Art

A liquid product dispenser is used for storing the liquid product inside the canisters and dispense the liquid product as per user requirement of the user. Liquid product dispensers are usually hollow containers that are made up of single body or multiple bodies for storing the liquid. The dispensers accommodate a dispensing head, a triggering element mounted on the surface of the dispenser and a storing unit.

Conventional dispensers are used for storing liquid product which are often disposable. These dispensers usually have a fixed canister portion that is disposed along with the dispenser body after use. The disposable cartridges usually come with a dispenser head, a pump assembly, and a single-use type canister that is not capable of being reused. These dispensers are used in storing liquid based or gel based formulations that can be dispensed directly onto the skin of the user. The liquid product includes soap based liquid products, cosmetic formulations, skin care liquid products and the like.

United States Patent Application No. 20020164193 to Tanya Brown, discloses about a cosmetic dispenser for holding and dispensing a cosmetic liquid product. The cosmetic dispenser includes an elongated container for holding a supply of cosmetic liquid product, an applicator brush attached to one end of said container, a protective shield slidably positioned within said container between a first position for covering said applicator brush when said dispenser is a non-dispensing mode and a second position exposing said applicator brush when said dispenser is in a dispensing mode, and an integrally formed dispensing mechanism within said container for forcing said cosmetic produce from said container to said brush.

The existing prior art discloses a single use type dispenser that dispenses cosmetic liquid product upon pressing. The limitation exists in disposing the dispenser once the bulk gets exhausted.

Canadian Patent No. 24,77,584 to Hygiene-Technik Inc, discloses about a bottle-like reservoir having an opening, a piston pump mechanism having a piston chamber and coupled to the opening of the reservoir and a piston member reciprocally slidable in the piston chamber to dispense flowable material, an actuator member having a support member fixedly coupled to the reservoir about its opening and a presser member engaging the piston extension and pivotally coupled to the support member for movement between an extended position and a retracted position, the dispenser is later disposed of after use.

Existing technologies disclose about a conventional method of dispensing the liquid products that is later disposed when the bulk is exhausted. A new dispenser is purchased each time along with the liquid product, whenever the liquid product is exhausted or a different liquid product is to be used by user. These conventional methods of disposing off the dispenser upon being exhausted with a new dispenser or purchasing different dispensers for accumulating different liquid product leads to accumulation of large number of plastics that ultimately leads to incineration of plastics. Purchasing dispensers each time may include a lot of expenses and liquid product. The incineration of plastic may further lead to environmental degradation and increase in carbon footprint. These incinerated plastics are later burnt out along with other waste materials that leads to liquid product of toxic fumes.

In order to overcome the above-mentioned limitations, there exists a need of developing a sustainable liquid product dispenser that is replenished by a user upon being exhausted, simultaneously managing the over wastage of liquid product, thus reducing incineration of plastic and ultimately minimizes carbon footprint. The present invention is therefore related to a replenishable liquid product dispenser having a canister that is easily detached from the dispenser and replenished easily, thereby making the liquid product reusable, refillable and cost-effective.

SUMMARY

The present invention relates to a replenishable dispenser for dispensing a liquid product. More particularly, the present invention relates to a canister replenishing mechanism, wherein the existing canister is replenished upon being exhausted, thereby making the liquid product sustainable. More particularly, the present invention relates to a dispenser with a canister, wherein the existing canister is replaceable with new canister or is refilled as per the volume of the liquid product stored inside the canister.

According to an embodiment of the present invention, there exists a replenishable dispenser that is reusable and reduces the use of components. The reusability of the dispenser reduces the cost of manufacturing all the necessary components involved in the dispenser and therefore makes the dispenser economic on the end of the user. The user needs to purchase a canister filled with the liquid product and replace the exhausted canister with the new filled canister, thereby making the dispenser replenishable and reduces the wastage of components and the manufacturing cost involved in the purchase of the dispenser and the liquid product.

According to an embodiment of the present invention, the replenishable dispenser comprises a housing, a canister, a triggering unit, an application member and a suction assembly. The dispenser further comprises a top cover. The canister, the application member and the suction assembly are connected to the housing and the triggering unit is connected to the canister. The canister stores a liquid product which is to be applied on a surface, wherein the liquid product is selected from at least one of the cosmetic liquid products or medicinal liquid products. The liquid product stored in the canister is a flowable liquid product.

According to an embodiment, the housing has a side wall extending along a central longitudinal axis and has an open distal end and an open proximal end forming a hollow cavity. The top cover is detachably mounted on a neck of the housing to prevent the accumulation of dirt and dust inside the canister. The top cover slidably fits on the neck of the housing by means of a snap fitment between a groove on an inner surface of the cover and a corresponding protrusion on an outer surface of the neck of the housing.

According to an embodiment of the present invention, the housing includes a window formed in the side wall to reveal the canister positioned coaxially inside the housing. The window extends along a portion of a length of the sidewall along the longitudinal axis of the housing. The window helps to reveal the level of the liquid product contained in the canister. A pellucid film may be affixed to the window of the housing. The pellucid film reveals the canister positioned coaxially inside the housing. The canister is positioned co-axially inside the hollow cavity of the housing for storing the liquid product. The canister has an open distal end and an open proximal end.

According to an embodiment of the present invention, the triggering unit is co-axially positioned at the open proximal end of the canister. The triggering unit having a neck and a body, is removably connected by a snap fitment at the proximal end of the canister. More specifically, the triggering unit has at least one protrusion on an outer surface of its neck for snap fitment into a corresponding groove present on an inner surface at the proximal end of the canister. Further, the body of the triggering unit remains outside the hollow cavity of the housing and is accessible to a user for pushing the canister along the longitudinal axis while using the dispenser.

The canister is configured to move in an upward and downward direction along the longitudinal axis of the housing. The proximal end of the canister detachably fits with the open proximal end of the housing to allow the canister to be replaced.

The triggering unit is configured to move in a pre-defined direction with respect to the housing to have a locked position and an unlocked position with respect to the housing. The triggering unit is rotated slightly about the longitudinal axis to lock and unlock the triggering unit with respect to the housing.

In the locked position, a U-shaped protrusion on an outer surface near the proximal end of the canister engages with a corresponding groove present on the inner surface near the proximal end of the housing. Specifically, the groove is a horizontal groove.

The triggering unit is rotated about the longitudinal axis to unlock the triggering unit. In the unlocked position, the U-shaped protrusion of the canister enters the vertical groove located adjacently to the horizontal groove on the inner surface of the housing so as to allow the movement of the canister along the longitudinal axis of the housing when the triggering unit is actuated. Further, the vertical groove prevents the canister from misalignment with respect to the housing during movement of the canister with respect to the housing.

According to an embodiment of the present invention, the canister further includes a perforated stopping wall near the proximal end that seals the bottom end of the canister thereby offering a surface for storing the liquid product. The perforation on the stopping wall of the canister works as an air passage for allowing the movement of air so as to create a suction pressure inside the canister to dispense the liquid product.

According to an embodiment of the present invention, a compressor tightly fits above the stopping wall of the canister. The compressor is inter-linked between the proximal end of the canister and the distal end of the triggering unit. The compressor is movable along the longitudinal axis X of the canister and reaches near the distal end of the canister when the liquid product inside the canister is completely used. The canister may not have a stopping wall and the compressor itself prevents leakage from the canister. Further, the canister includes at least two grooves formed on an outer surface of its neck. Two O-rings are positioned into the respective at least two grooves.

According to an embodiment of the present invention, a suction assembly is detachably disposed at the distal end of the canister. Further, a lower portion of the suction assembly is housed inside a hollow cavity of the canister while an upper portion of the suction assembly is housed inside the hollow cavity of the housing.

The suction assembly is preferably a vacuum sealed suction assembly. The term vacuum sealed suction refers to a suction assembly that undergoes suction and dispenses the stored liquid product from the canister upon applying pressure in essentially a single direction without permitting reverse (intake) flow of air via the suction assembly. As the liquid product is sucked from the canister, the sucked liquid product is not replaced with a corresponding volume of air through the suction assembly. In addition to preventing the reverse intake or flow of air, the vacuum sealed suction assembly typically does not allow intake of any other substances to replace the volume of liquid product sucked out of the canister. For example, a vacuum sealed suction assembly includes a one-way valve, such as a check valve. The suction assembly allows for an adjustable amount of liquid product to be dispensed, depending on how far the triggering unit is pressed in upward direction with respect to the housing or how many times the triggering unit is pressed in upward direction, thereby supporting a manually controlled dispensing of the liquid product.

According to an embodiment of the present invention, the vacuum sealed suction assembly further includes a receptacle, a vacuum sealed member and a conduit. The check valve is disposed on the proximal end of the receptacle. The check valve allows a one-way suction of the liquid product stored inside the canister, wherein the one-way suction is typically from proximal end to the distal end of the suction assembly.

The suction assembly comprises of a holder detachably connected to the canister. The holder comprises an upper portion and a lower portion wherein the lower portion has a shoulder; an outer skirt and an inner skirt extending in downward direction from the shoulder. The lower portion of the suction assembly is fitted onto the neck of the canister such that the shoulder rests on a top surface of the neck of the canister and the neck rests inside a gap between the outer skirt and the inner skirt. A pair of O-rings positioned in the respective grooves on the outer surface of the neck of the canister provides a detachable fitment between holder of the suction assembly and the neck of the canister. The holder of the suction assembly can be detachably fitted with the canister by other fitments known in the art for e.g. snap-connection, screw connection or any other suitable connection between the outer surface of the neck of the canister and the inner surface of the outer skirt of the holder.

According to an embodiment of the present invention, the receptacle is disposed near a proximal end of the upper portion of the holder. The check-valve is attached at the bottom of the receptacle. The vacuum sealed member is fitted inside a cavity of the receptacle from a distal end of the receptacle. The vacuum sealed member is oriented concentrically within the receptacle and moves in a direction along the axis of the receptacle. An insert is disposed on the distal end of the holder such that the holder is slidable with respect to the insert and is configured to move inside a hollow cavity of the upper portion of the holder.

According to a further embodiment of the present invention, the insert is fixedly connected to a lower portion of a conduit of the housing in such a way that the conduit of the housing is aligned with the conduit of the suction assembly forming a passage that allows the flow of the liquid product from the receptacle.

A distal opening at the open distal end of the housing is enclosed by the application member. The application member incorporates a holding unit and an applicator tip. The holding unit can be provided in various shapes and sizes and is selected based on the inner circumference of the open distal end of the housing. The outer surface of the holding unit is detachably connected to the inner surface at the distal end of the housing by snap fitment between a protrusion on an outer surface of the holding unit and a groove on an inner surface of the open distal end of the housing. It would not be outside the scope of present disclosure if the outer surface of the holding unit is connected to the inner surface at the distal end of the housing by a threaded engagement, a magnetic engagement and the like.

According to an embodiment of the present invention, the holding unit includes a see-through cavity, a lower end of which is detachably connected to the application tip by snap fitment. It would not be outside the scope of present disclosure if the application tip is connected to the holding unit by a threaded engagement, a magnetic engagement and the like. The type of the application tip is selected based on the requirement of the user. The application tip is selected from a group consisting of molded applicators like doe-foot applicator, brush type applicator, sponge type applicator and the like. The application tip may be secured from external damages by an additional dust cover that is further enclosed by the top cover to protect the dispenser. The Application tip further has a passageway which is aligned with the conduit of the housing and the conduit of the suction assembly to form a single passageway for carrying the liquid product from the canister to the application tip.

The canister can be removed from the distal end of the housing along with the compressor upon being exhausted and replenished with a new canister or filled again with the liquid product for use, thus making the dispenser replenishable. In order to remove the canister from the housing, the triggering unit is pulled in the downward direction. The pull force disengages the canister from the holder of the suction assembly and from the housing.

According to an embodiment of the present invention, the triggering unit is first brought in the unlocked position and then pulled in the downward direction to disengage the canister from the holder of the suction assembly and from the housing. The new canister is loaded inside the housing and removably fixed to the housing and the existing suction assembly by snap fitment as explained earlier or by any other engagement means known in the art.

The canister is provided separately along with the dust cover or attached inside the dispenser during the initial use.

During use, the user first brings the triggering unit in the unlocked position and then manually operates the triggering unit by pushing the triggering unit in the upward direction. The pushing force on the triggering unit pushes the canister in the upward direction along the vertical groove fabricated in the housing which in turn pushes the holder and the receptacle of the suction assembly in the upward direction resulting in compression of the helical member between the holder and the insert of the suction assembly. The compression of the helical member towards the insert causes the vacuum sealed member to move in the upward direction and open an orifice present in the conduit of the suction assembly resulting in flow of liquid product from the receptacle to the passageway of the conduit. Further, the liquid product flows from the co-axially aligned passageways of the conduit of the suction assembly, the conduit of the housing and the passageway of the applicator tip.

According to an embodiment of the present invention, as the push force from the triggering unit is released, the canister moves in downward direction and the helical member again expands creating a suction force which causes the check valve to open and liquid product from the canister enters the receptacle of the suction assembly and simultaneously the compressor of the canister travels in the upward direction due to the force generated. The compressor displaces in the upward direction up to a certain height equivalent to balance the pressure created inside the canister. The displacement of the compressor allows the movement of the liquid product towards the distal end of the canister. The liquid product now available in the receptacle of the suction assembly can be dispensed again through the applicator tip by pushing the triggering unit.

The liquid product present inside the canister gets compressed each time the compressor displaces from the rest position upon experiencing pressure. The compressed liquid product is flushed into the receptacle of the suction assembly through the check valve. The check valve allows one-way movement of the liquid product i.e. in upward direction only. The liquid product left behind in the suction assembly after dispensing does not pass through the check valve in a downward direction and gets stored inside the receptacle for upcoming usage. The triggering unit is activated each time a force is experienced at the bottom and the process gets repeated to dispense the liquid product on the user's skin.

According to an embodiment of the present invention, the amount of liquid product dispensed by the dispenser can be varied by varying the travel distance of the canister with respect to the housing, the travel distance of the holder of the suction assembly with respect to the insert of the suction assembly and the volume of the receptacle of the suction assembly. The liquid product released from the application tip can be applied on the skin of the user.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

FIG. 5(*b*) is a front view of FIG. 5(*a*);

FIG. 5(*c*) is a cross sectional view of FIG. 5(*a*);

FIG. 6(*b*) is a front view of FIG. 6(*a*)

FIG. 6(*c*) is a cross sectional view of FIG. 6(*a*);

FIG. 7(*b*) is a front view of FIG. 7(*a*).

Figure 1:
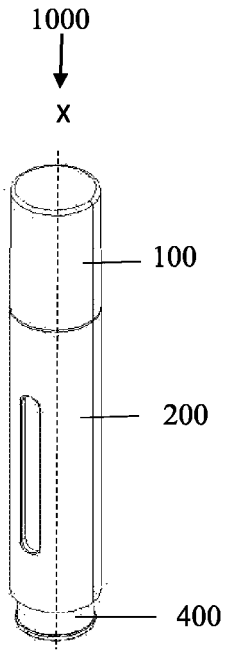
FIG. 1 is an isometric view of a replenishable dispenser according to an embodiment of the present invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

Throughout this specification, the terms "comprise," "comprises," "comprising" and the like, shall consistently mean that a collection of objects is not limited to those objects specifically recited.

Figure 2:
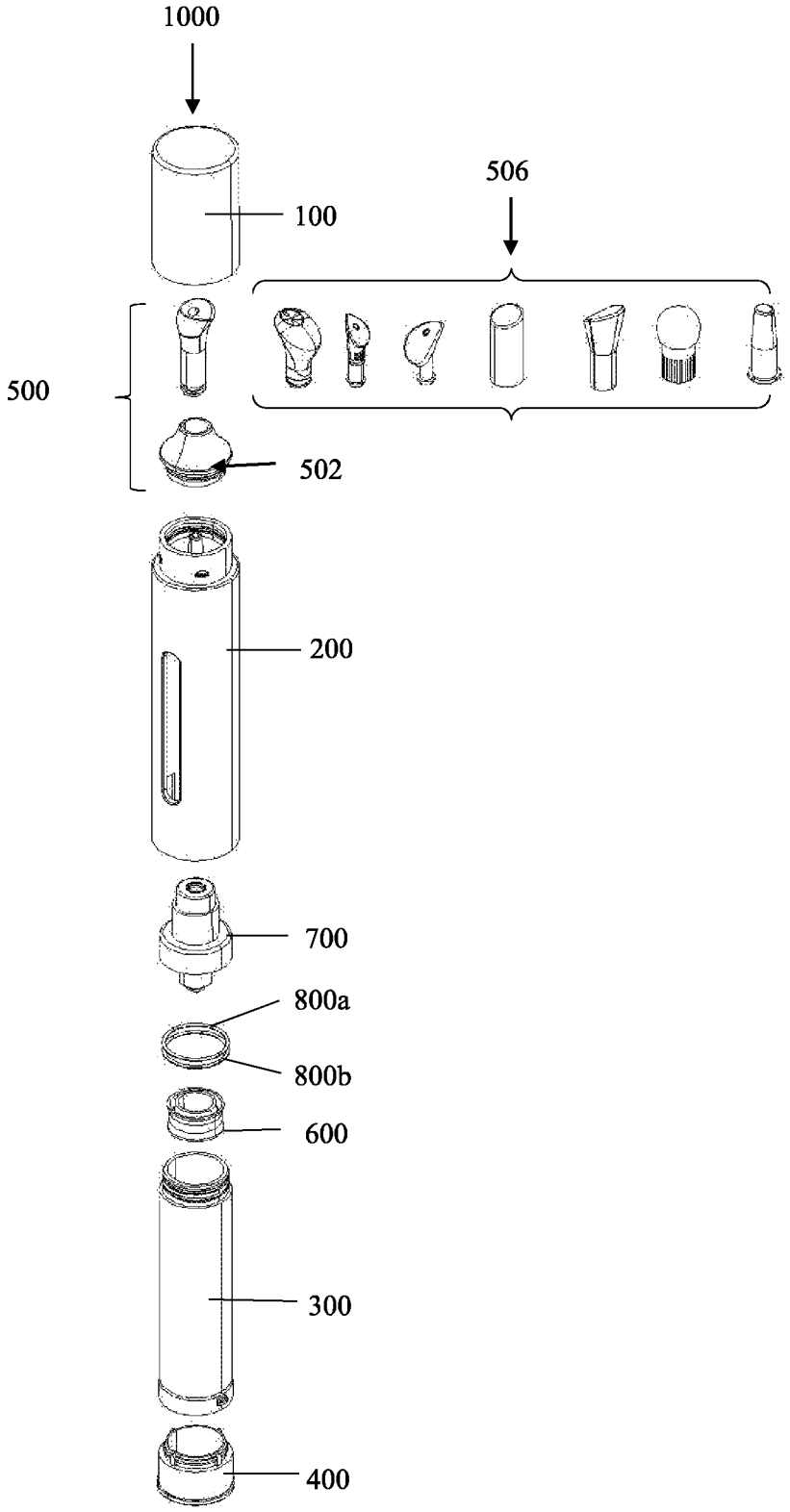
FIG. 2 is an exploded view of the replenishable dispenser of FIG. 1.
Figure 3:
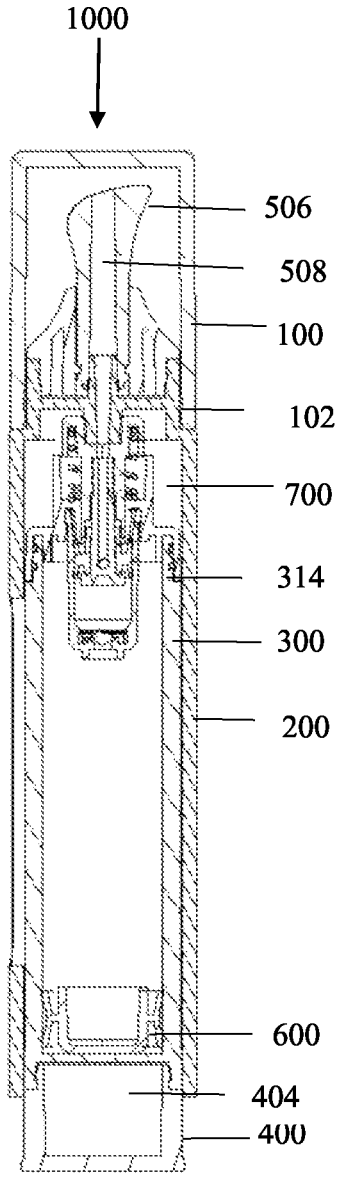
FIG. 3 is a cross-sectional view of the replenishable dispenser of FIG. 1.

FIGS. 1 to 3 illustrate a replenishable dispenser 1000 in accordance with an embodiment of the present invention. The replenishable dispenser 1000 comprises a housing 200, a canister 300, a triggering unit 400, an application member 500 and a suction assembly 700. The dispenser 1000 further comprises a top cover 100. The canister 300, the application member 500 and the suction assembly 700 are connected to the housing 200 and the triggering unit 400 is connected to the canister 300. The canister 300 stores a liquid product (not shown) which is to be applied on a surface, wherein the liquid product is selected from at least one of the cosmetic liquid products or medicinal liquid products. The liquid product stored in the canister 300 is a flowable liquid product for e.g. a solution, suspension, a viscous liquid etc.

As shown in FIGS. 1-5(*c*) the housing 200 has a side wall 202 extending along a central longitudinal axis X and has an open distal end 202*a* and an open proximal end 202*b* forming a hollow cavity 202*c*.

The top cover 100 is detachably mounted on a neck 204 of the housing 200 to prevent the accumulation of dirt and dust inside the canister 300. The top cover 100 slidably fits on the neck 204 of the housing 200 by means of a snap fitment between a groove 102 on an inner surface of the cover 100 and a corresponding protrusion 204*a* on an outer surface of the neck 204. It would not be outside the scope of present disclosure if the top cover 100 and the housing 200 are coupled by any other engagement means capable of removably coupling the top cover 100 and the housing 200 for e.g. j-lock, magnetic engagement, screw threads etc.

According to an embodiment, the housing 200 includes a window 206 formed in the side wall 202 to reveal the canister 300 positioned coaxially inside the housing 200. The window 206 extends along a portion of a length of the sidewall 202 along the longitudinal axis 'X' of the housing 200. The window 206 helps to reveal the level of the liquid product contained in the canister 300.

According to an alternate embodiment, a pellucid film is affixed to the window 206 of the housing 200. The pellucid film reveals the canister 300 positioned coaxially inside the housing 200.

Figure 4:
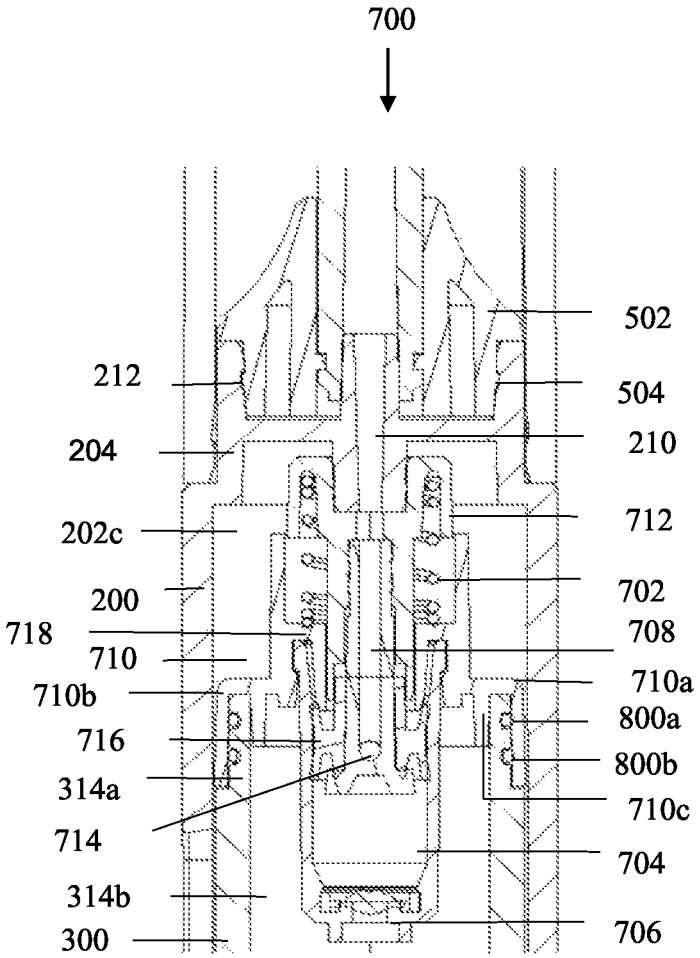
FIG. 4 is an enlarged view of a portion of the cross-sectional view of FIG. 3 showing a suction assembly of the replenishable dispenser.
Figure 6A:
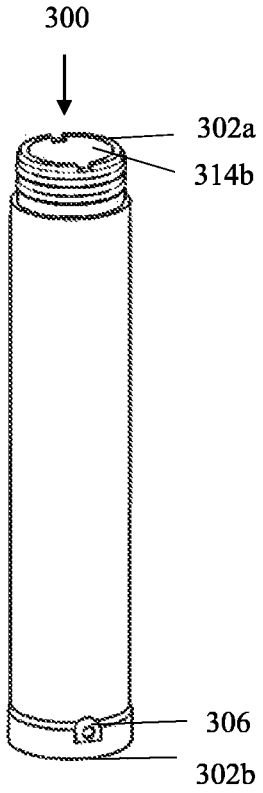
FIG. 6(*a*) is an isometric view of a canister of the replenishable dispenser of FIG. 1, shown in isolation.
Figure 6B:
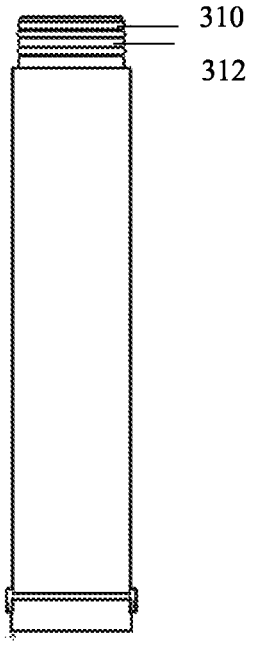
Figure 6C:
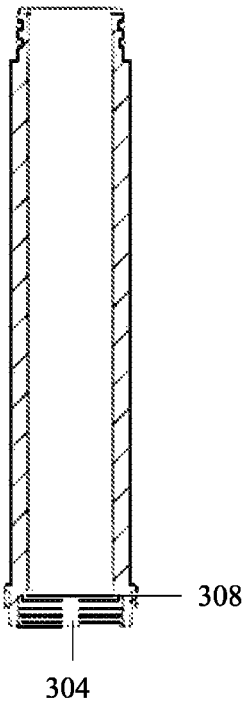

As shown in FIGS. 2-4, the canister 300 is positioned co-axially inside the hollow cavity 202*c* of the housing 200 for storing the liquid product. The canister 300 has an open distal end 302*a* and an open proximal end 302*b* as shown in FIG. 6(*a*).

Figure 7A:
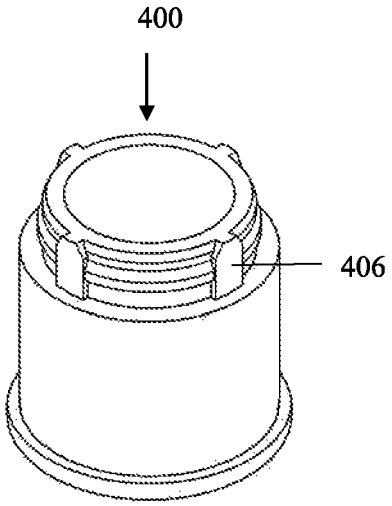
FIG. 7(*a*) is an isometric view of a triggering unit of the replenishable dispenser of FIG. 1, shown in isolation.
Figure 7B:
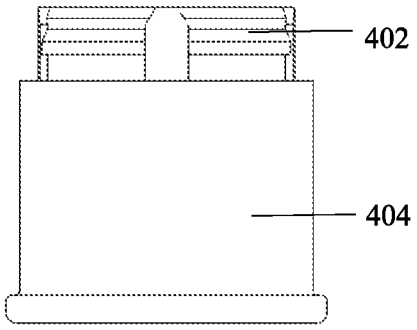

The triggering unit 400 is co-axially positioned at the open proximal end 302*b* of the canister 300 as shown in FIG. 3. The triggering unit 400 having a neck 402 and a body 404 as shown in FIGS. 7(*a*) and 7(*b*), is removably connected by a snap fitment at the proximal end 302*b* of the canister 300. More specifically, the triggering unit 400 has at least one protrusion 406 on an outer surface of its neck 402 for snap fitment into a corresponding groove 304 as shown in FIG. 6(*c*) present on an inner surface at the proximal end 302*b* of the canister 300. It would not be outside the scope of the present disclosure if the triggering unit 400 is coupled to the proximal end of the housing 200 by other coupling means such as screw threads, magnet and the like known in the art. Further, the body 404 of the triggering unit 400 remains outside the hollow cavity 202*c* of the housing 200 and is accessible to a user for pushing the canister 300 along the longitudinal axis X while using the dispenser 1000.

The canister 300 is configured to move in an upward and downward direction along the longitudinal axis X of the housing 200. The proximal end 302*b* of the canister detachably fits with the open proximal end 202*b* of the housing 200 as shown in FIG. 3.

The triggering unit 400 is configured to move in a pre-defined direction with respect to the housing 200 to have a locked position and an unlocked position with respect to the housing 200. The triggering unit 400 is rotated slightly along the longitudinal axis X to lock and unlock the triggering unit 400 with respect to the housing 200.

Figure 5A:
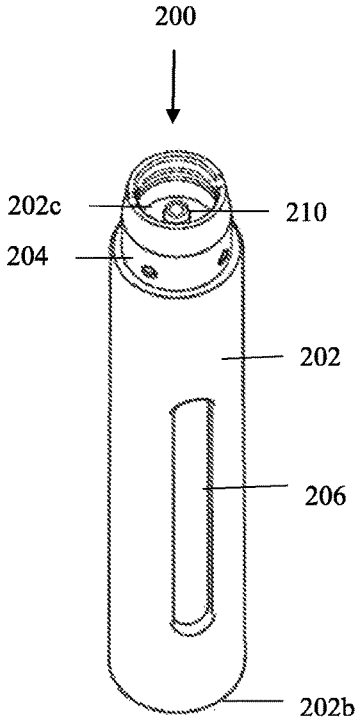
FIG. 5(*a*) is an isometric view of a housing of the replenishable dispenser of FIG. 1, shown in isolation.
Figure 5B:
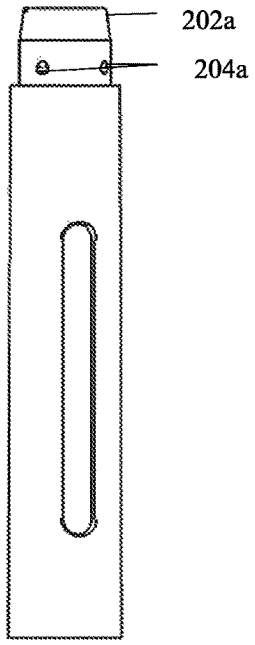
Figure 5C:
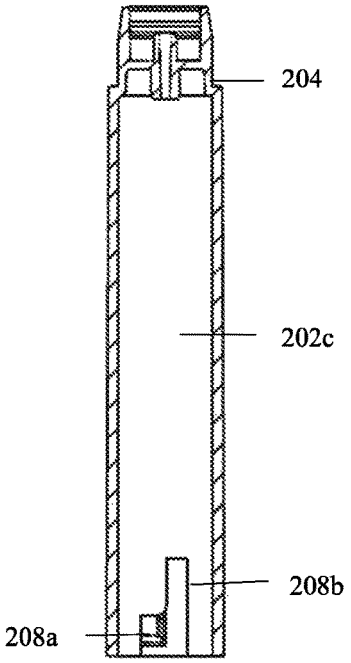

In the locked position, a U-shaped protrusion 306 shown in FIG. 6(*a*) on an outer surface near the proximal end 302*b* of the canister 300 engages with a corresponding groove 208*a* shown in FIG. 5(*c*) present on the inner surface near the proximal end 202*b* of the housing 200. Specifically, the groove 208*a* is a horizontal groove.

In the unlocked position, the U-shaped protrusion 306 of the canister 300 enters the vertical groove 208*b* shown in FIG. 5(*c*) located adjacently to the groove 208*a* on the inner surface of the housing 200 so as to allow the movement of the canister 300 along the longitudinal axis X of the housing 200 when the triggering unit 400 is actuated. Further, the vertical groove 208*b* prevents the canister 300 from misalignment with respect to the housing 200 during movement of the canister 300 with respect to the housing 200.

The canister 300 further includes a perforated stopping wall 308 shown in FIG. 6(*c*) near the proximal end 302*b* that seals the bottom end of the canister 300 thereby offering a surface for storing the liquid product. The perforation on the stopping wall 308 of the canister 300 works as an air passage for allowing the movement of air so as to create a suction pressure inside the canister 300 to dispense the liquid product.

As shown in FIG. 3, a compressor 600 tightly fits above the stopping wall 308 of the canister 300. The compressor 600 is inter-linked between the proximal end of the canister 300 and the distal end of the triggering unit 400. The compressor 600 is movable along the longitudinal axis X of the canister 300 and reaches near the distal end 302*a* of the canister 300 when the liquid product inside the canister 300 is completely used. According to other embodiment, the canister 300 does not have a stopping wall 308 and the compressor 600 itself prevents leakage from the canister 300.

Further, the canister 300 includes at least two grooves 310, 312 formed on an outer surface of its neck 314*a*. Two O-rings 800*a*, 800*b* are positioned into the respective at least two grooves 310, 312.

Further, as shown in FIGS. 3 and 4, a suction assembly 700 is detachably disposed at the distal end 302*a* of the canister 300. Further, a lower portion of the suction assembly 700 is housed inside a hollow cavity 314*b* of the canister 300 while an upper portion of the suction assembly 700 is housed inside the hollow cavity 202*c* of the housing 200.

The suction assembly 700 is preferably a vacuum sealed suction assembly 700. The term vacuum sealed suction refers to a suction assembly 700 that undergoes suction and dispenses the stored liquid product from the canister 300 upon applying pressure in essentially a single direction without permitting reverse (intake) flow of air via the suction assembly 700. As the liquid product is sucked from the canister 300, the sucked liquid product is not replaced with a corresponding volume of air through the suction assembly 700. In addition to preventing the reverse intake or flow of air, the vacuum sealed suction assembly 700 typically does not allow intake of any other substances to replace the volume of liquid product sucked out of the canister 300. For example, a vacuum sealed suction assembly includes a one-way valve 706, such as a check valve 706. The suction assembly 700 allows for an adjustable amount of liquid product to be dispensed, depending on how far the triggering unit 400 is pressed in upward direction with respect to the housing 200 or how many times the triggering unit 400 is pressed in upward direction, thereby supporting a manually controlled dispensing of the liquid product.

As shown in FIGS. 3 and 4, the vacuum sealed suction assembly 700 further includes a receptacle 704, a vacuum sealed member 716 and a conduit 708. The check valve 706 is disposed on the proximal end of the receptacle 704. The check valve 706 allows a one-way suction of the liquid product stored inside the canister 300, wherein the one-way suction is typically from proximal end to the distal end of the suction assembly 700.

In an embodiment, the suction assembly 700 comprises of a holder 710 detachably connected to the canister 300. In an embodiment, the holder 710 comprises an upper portion and a lower portion wherein the lower portion has a shoulder 710*a*; an outer skirt 710*b* and an inner skirt 710*c* extending in downward direction from the shoulder 710*a*. The lower portion of the suction assembly 700 is fitted onto the neck 314*a* of the canister 300 such that the shoulder 710*a* rests on a top surface of the neck 314*a* of the canister 300 and the neck 314*a* rests inside a gap between the outer skirt 710*b* and the inner skirt 710*c*. A pair of O-rings 800*a*, 800*b* positioned in the respective grooves 310, 312 on the outer surface of the neck 314*a* of the canister 300 provides a detachable fitment between holder 710 of the suction assembly 700 and the neck 314*a* of the canister 300. The O-rings 800*a*, 800*b* like structure are made up of a soft material, preferably a rubber and have a diameter equivalent to the circumference of the canister 300. In alternate embodiments, the holder 710 of the suction assembly 700 can be detachably fitted with the canister 300 by other fitments known in the art for e.g. snap-connection, screw connection or any other suitable connection between the outer surface of the neck 314*a* of the canister 300 and the inner surface of the outer skirt 710*b* of the holder 710.

The receptacle 704 is disposed near a proximal end of the upper portion of the holder 710. The check-valve 706 is attached at the bottom of the receptacle 704. The vacuum sealed member 716 is fitted inside a cavity of the receptacle 704 from a distal end of the receptacle. The vacuum sealed member 716 is oriented concentrically within the receptacle 704 and moves in a direction along the axis of the receptacle 704. An insert 712 is disposed on the distal end of the holder 710 such that the holder 710 is slidable with respect to the insert 712 and is configured to move inside a hollow cavity of the upper portion of the holder 710.

The insert 712 houses a helical member 702 and the conduit 708 which is disposed inside the vacuum sealed member 716. A lower end of the helical member 702 engages with a wall 718 extending from an inner surface of the upper portion of the holder 710 and an upper end of the helical member 702 engages a distal inner surface of the insert 712. The helical member 702 biases the canister 300 in the downward direction.

Further, the insert 712 is fixedly connected to a lower portion of a conduit 210 of the housing 200 in such a way that the conduit 210 of the housing 200 is aligned with the conduit 708 of the suction assembly 700 forming a passage that allows the flow of the liquid product from the receptacle 704.

A distal opening at the open distal end 202*a* of the housing 200 is enclosed by the application member 500. The application member 500 incorporates a holding unit 502 and an applicator tip 506. The holding unit 502 can be provided in various shapes and sizes and is selected based on the inner circumference of the open distal end 202*a* of the housing 200. The outer surface of the holding unit 502 is connected to the inner surface at the distal end of the housing 200 by snap fitment between a protrusion 504 on an outer surface of the holding unit 502 and a groove 212 on an inner surface of the open distal end of the housing 200. It would not be outside the scope of present disclosure if the outer surface of the holding unit 502 is connected to the inner surface at the distal end of the housing 200 by a threaded engagement, a magnetic engagement and the like.

The holding unit 502 includes a see-through cavity, a lower end of which is detachably connected to the application tip 506 by snap fitment. It would not be outside the scope of present disclosure if the application tip 506 is connected to the holding unit 502 by a threaded engagement, a magnetic engagement and the like. The type of the application tip 506 is selected based on the requirement of the user. The application tip 506 is selected from a group consisting of a molded applicator like doe-foot applicator, brush type applicator, sponge type applicator and the like. The application tip 506 may be secured from external damages by an additional dust cover (not shown) that is further enclosed by the top cover 100 to protect the dispenser 1000. The application tip 506 further has a passageway 508 which is aligned with the conduit 210 of the housing 200 and the conduit 708 of the suction assembly 700 to form a single passageway 508 for carrying the liquid product from the canister 300 to the application tip 506.

The canister 300 can be removed from the distal end of the housing 300 along with the compressor 600 upon being exhausted and replenished with a new canister 300 for use, thus making the dispenser 1000 replenishable. In order to remove the canister 300 from the housing 200, the triggering unit 400 is pulled in the downward direction. The pull force disengages the canister 300 from the holder 710 of the suction assembly 700 and from the housing 200. In an embodiment, the triggering unit 400 is first brought in the unlocked position and then pulled in the downward direction to disengage the canister 300 from the holder 710 of the suction assembly 700 and from the housing 200. The new canister 300 is loaded inside the housing 200 and removably fixed to the housing 200 and the existing suction assembly 700 by snap fitment as explained earlier or by any other engagement known in the art.

The canister is provided separately along with the dust cover or attached inside the dispenser 1000 during the initial use.

During use, the user first brings the triggering unit 400 in the unlocked position and then manually operates the triggering unit 400 by pushing the triggering unit 400 in the upward direction. The pushing force on the triggering unit 400 pushes the canister 300 in the upward direction along the vertical groove 208*b* fabricated in the housing 200 which in turn pushes the holder 710 and the receptacle 704 of the suction assembly 700 in the upward direction resulting in compression of the helical member 702 between the holder 710 and the insert 712 of the suction assembly 700. The compression of the helical member 702 towards the insert 712 causes the vacuum sealed member 716 to move in the upward direction and open an orifice 714 present in the conduit 708 of the suction assembly 700 resulting in flow of liquid product from the receptacle 704 to the passageway of the conduit 708. Further, the liquid product flows from the co-axially aligned passageways of the conduit 708 of the suction assembly, the conduit 210 of the housing 200 and the passageway 508 of the applicator tip 506.

As the push force from the triggering unit 400 is released, the canister 300 moves in downward direction and the helical member 702 again expands creating a suction force which causes the check valve 706 to open and liquid product from the canister 300 enters the receptacle 704 of the suction assembly 700 and simultaneously the compressor 600 of the canister 300 travels in the upward direction due to the force generated. The compressor 600 displaces in the upward direction up to a certain height equivalent to balance the pressure created inside the canister 300. The displacement of the compressor 600 allows the movement of the liquid product towards the distal end of the canister 300. The liquid product now available in the receptacle 704 of the suction assembly can be dispensed again through the applicator tip 506 by pushing the triggering unit 400.

The liquid product present inside the canister 300 gets compressed each time the compressor 600 displaces from the rest position upon experiencing pressure. The compressed liquid product is flushed into the receptacle 704 of the suction assembly 700 through the check valve 706. The check valve 706 allows one-way movement of the liquid product i.e. in upward direction only.

The liquid product left behind in the suction assembly 700 after dispensing does not pass through the check valve 706 in a downward direction and gets stored inside the receptacle 704 for upcoming usage. The triggering unit 400 is activated each time a force is experienced at the bottom and the process gets repeated to dispense the liquid product on the user's skin.

The amount of liquid product dispensed by the dispenser 1000 can be varied by varying the travel distance of the canister 300 with respect to the housing 200, the travel distance of the holder 710 of the suction assembly 700 with respect to the insert 712 of the suction assembly and the volume of the receptacle 704 of the suction assembly 700.

The liquid product released from the application tip 506 can be applied on the skin of the user. The application tip 506 applies the liquid product on the surface of the user like skin, lips, eyes, and the like.

In other alternate embodiments, the suction assembly may be a dip tube assembly or any other assembly capable of sucking product from the canister to the actuator.

The housing 200 of the dispenser 1000 is injection molded from various polymeric materials known in the art. More particularly, the housing 200 of the dispenser 1000 is injection molded polypropylene material to form a cylindrical shape. Alternatively, the shape of the housing 200 may be rectangular, elliptical, cuboidal, cubical and the like.

The canister 300 of the dispenser 1000 is injection molded from various polymeric materials known in the art. The canister 300 is made up of a material similar to the housing 200 and is manufactured by an injection molded process into a cylindrical shape. The shape is chosen to be cylindrical for disposing a compressor 600. The dimension of the canister 300 depends on the dimension of the housing 200. According to an embodiment, the canister 300 is made up of a transparent material to allow the user to view the level of the liquid product inside the canister 300.

The triggering unit 400 is selected to be octagonal in shape, but could also be spherical, cylindrical, hexagonal, and the like. The material and the process of manufacturing the triggering unit 400 possess similarity with the housing 200 and the canister 300.

The diameter of the top cover 100 is equivalent to the outer diameter of the housing 200 and is made up of injection molded clear amorphous thermoplastic material polyethylene terephthalate glycol-modified that provides the user an experience to see through the cover. The top cover 100 may be made up of any other material known in the art.

The vacuum sealed member 716, is made up of an injection molded polyethylene material or any other polymeric material known in the art. The application member including a holding unit 502 and an application tip 506 can be made up of injection molded polymeric materials known in the art. According to an embodiment. the application tip 506 is made up of nylon and hytrel and the holding unit 502 is made up of polypropylene.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

What is claimed is:

1. A replenishable dispenser for dispensing a liquid product, comprising:

a housing having a sidewall extending along a central longitudinal axis, the housing having an open distal end, an open proximal end and a hollow cavity;

a canister storing the liquid product and comprising an open distal end and an open proximal end, wherein the canister is co-axially positioned inside the hollow cavity of the housing and detachably connected at the proximal end of the housing, and wherein the canister is configured to move along the central longitudinal axis with respect to the housing;

a suction assembly mounted on the distal end of the canister for suction of the liquid product stored in the canister, wherein the canister is detachably connected with the suction assembly;

an application member comprising a holding unit and an applicator tip, the holding unit is connected to an inner surface at the distal end of the housing and the applicator tip is detachably connected to the holding unit; and a triggering unit co-axially positioned at the open proximal end of the canister to actuate the suction assembly to dispense the liquid product from the canister to the application tip, wherein a holder of the suction assembly comprises an upper portion and a lower portion, wherein the lower portion has a shoulder; an outer skirt and an inner skirt extending in downward direction from the shoulder; and wherein the shoulder rests on a top surface of a neck of the canister and the neck rests inside a gap between the outer skirt and the inner skirt.

2. The replenishable dispenser as claimed in claim 1, wherein the housing includes a window formed in the side wall and wherein the window extends along a portion of a length of the sidewall along the central longitudinal axis.

3. The replenishable dispenser as claimed in claim 1, wherein the holding unit includes a see-through cavity and wherein a lower end of the see-through cavity is detachably connected to the application tip.

4. The replenishable dispenser as claimed in claim 1, wherein the application tip is selected from a group consisting of molded applicator, brush type applicator and sponge type applicator.

5. The replenishable dispenser as claimed in claim 1, wherein the canister includes a compressor movable along the central longitudinal axis.

6. The replenishable dispenser as claimed in claim 1, wherein the suction assembly is selected from a dip tube or a vacuum sealed mechanism.

7. The replenishable dispenser as claimed in claim 1, wherein the suction assembly comprises of a receptacle, a check valve, a helical member, an insert, a conduit, and a holder.

8. The replenishable dispenser as claimed in claim 1, wherein a pair of O-rings positioned in a pair of grooves on an outer surface of a neck of the canister provides a detachable fitment between a holder of the suction assembly and the neck of the canister.

9. The replenishable dispenser as claimed in claim 1, wherein the holder of the suction assembly is detachably connected with the canister by snap-connection or screw threads between an outer surface of the neck of the canister and an inner surface of the outer skirt of the holder.

10. The replenishable dispenser as claimed in claim 1, wherein a conduit of the suction assembly, a conduit of the housing and a conduit of the application member are co-axially aligned to form a single passageway to dispense the liquid product.

11. A replenishable dispenser for dispensing a liquid product, comprising:

a housing extending along a central longitudinal axis, the housing having an open distal end, an open proximal end and a hollow cavity;

a canister storing the liquid product and comprising an open distal end and an open proximal end, wherein the canister is co-axially positioned inside the hollow cavity of the housing and detachably connected with the housing; wherein the canister is completely enclosed inside the housing and wherein the canister is configured to move along the central longitudinal axis with respect to the housing;

a suction assembly mounted on the distal end of the canister for unidirectional suction of the liquid product stored in the canister, wherein the canister is detachably connected with the suction assembly;

a triggering unit co-axially positioned and fixedly connected at the open proximal end of the canister such that there is no relative movement between the triggering unit and the canister;

wherein the triggering unit is configured to have a locked position and an unlocked position with respect to the housing by rotating the triggering unit with respect to the housing about the central longitudinal axis;

wherein the rotation of the triggering unit causes the canister to rotate along with the triggering unit;

wherein the triggering unit is not operatively engaged directly or indirectly to an proximal end portion of the housing;

wherein in the locked position, a protrusion on an outer surface near the proximal end of the canister engages with a horizontal groove present on an inner surface near the proximal end of the housing to disable movement of the canister along the central longitudinal axis of the housing;

wherein in the un-locked position, the protrusion of the canister enters a vertical groove located adjacently to the horizontal groove on the inner surface of the housing;

wherein in the un-locked position, the triggering unit can be pushed in upward direction to allow the movement of the canister along the central longitudinal axis of the housing to actuate the suction assembly to dispense the liquid product from the canister; and wherein to remove the canister from the housing, the triggering unit is first brought in the un-locked position from the locked position by rotating the triggering unit, and then the triggering unit is pulled in downward direction to disengage the canister from the suction assembly and from the housing.

12. The replenishable dispenser as claimed in claim 11, wherein the movement of the canister along the central longitudinal axis of the housing actuates the suction assembly to dispense the liquid product from the canister towards an application member.

* * * * *